United States Patent [19]

Fitzgerald et al.

[11] 4,295,292

[45] Oct. 20, 1981

[54] DEMOLITION DERBY TOY

[75] Inventors: Stella Fitzgerald, Las Vegas, Nev.; Bryan Beaver, 3660 Boulder Hwy. - Space 129, Las Vegas, Nev. 89121

[73] Assignee: Bryan Beaver, Las Vegas, Nev.

[21] Appl. No.: 102,436

[22] Filed: Dec. 11, 1979

[51] Int. Cl.[3] ..... A63H 11/10

[52] U.S. Cl. ..... 46/201; 46/223; 46/240

[58] Field of Search ..... 46/201, 202, 221, 222, 46/223, 206, 240, 239, 236, 210, 251; 273/1 M, 86 B

[56] References Cited

U.S. PATENT DOCUMENTS

| | | | |
|---|---|---|---|
| 1,288,813 | 12/1918 | Blackshear | 46/201 |
| 1,363,891 | 12/1920 | Lovington | 46/201 |
| 1,546,431 | 7/1925 | Brandt | 46/145 X |
| 2,721,742 | 10/1955 | Whitlock | 46/239 |
| 2,757,482 | 8/1956 | Brown et al. | 46/201 |
| 3,176,429 | 4/1965 | Brown et al. | 46/17 |
| 3,668,804 | 6/1972 | Winston | 46/17 |
| 3,859,752 | 1/1975 | Morrison et al. | 46/201 |

*Primary Examiner*—Robert Peshock
*Assistant Examiner*—Mickey Yu
*Attorney, Agent, or Firm*—Jay M. Cantor

[57] ABSTRACT

A demolition derby game wherein vehicles are positioned on a gameboard and driven by means of manually operated magnetic manipulators positioned beneath the gameboard. There are plural such vehicles, one vehicle operated by each player. Each vehicle includes a plurality of identical removable elements, such removable elements being removable upon impact with another vehicle. The removable elements fit into grooves in the vehicle and are positioned about opposite sides of shafts with spring elements and disc portions at their ends. The impact of a vehicle with another vehicle will cause a shaft to move and force one of the removable elements out of its groove and onto the playing surface.

8 Claims, 6 Drawing Figures

Fig. 1
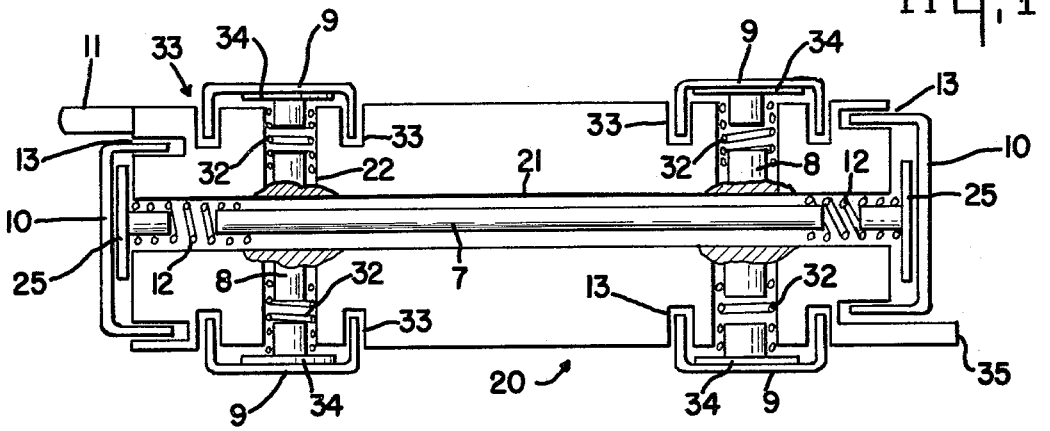
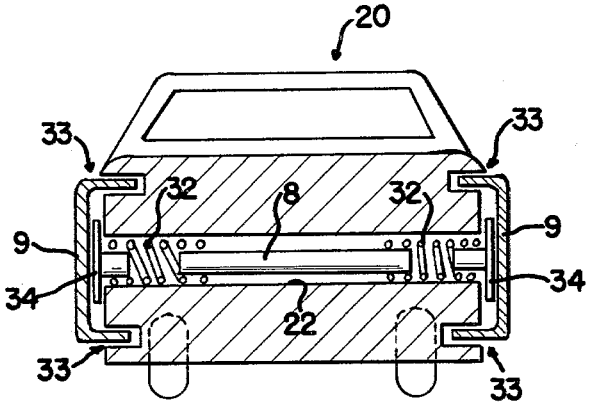
Fig. 2
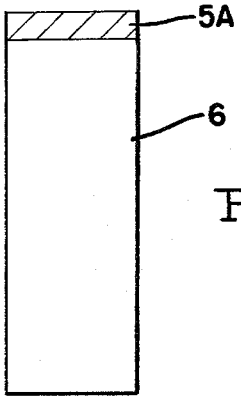
Fig. 4
Fig. 3
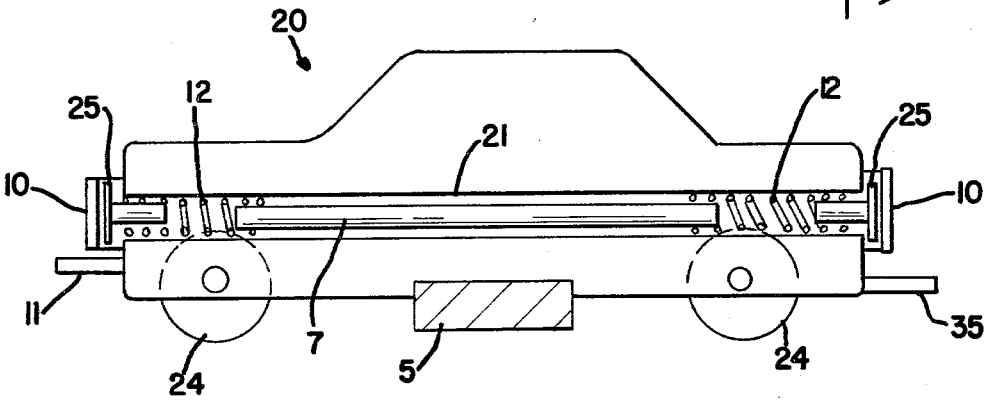

DEMOLITION DERBY TOY

BACKGROUND OF THE INVENTION

1. Field of the Invention

This invention relates to a demolition derby type toy and game whereby toy portions are removed from the toy upon impact with other similar toys.

2. Description of the Prior Art

Demolition derby has been a popular sport. The problem is that only certain persons can participate in this sport and such sport is certainly not available to children. In accordance with the present invention, there is provided a safe toy and game which is capable of simulating a real demolition derby and wherein the vehicles can be easily reassembled for reuse and replay of the game.

SUMMARY OF THE INVENTION

The invention includes a thin non-magnetic gameboard over which vehicles with magnets therein can slide and which is sufficiently thin so that a magnet, placed beneath the table and beneath a vehicle on the table, can propel the vehicle on the surface of the table. The table also includes a boundary fence to keep the vehicles on the playing surface. Each vehicle includes a shaft extending from the front to the rear of the vehicle and supporting a spring at either end, each spring in turn supporting a disc which extends beyond the forward and rear portions of the vehicle. Grooves are provided at the front and rear of the vehicle for front and rear fenders which at least partially surround the discs. A similar arrangement is provided for a pair of front and a pair of rear fenders. A ramming pin or ramrod is provided at a front corner and a rear corner of each vehicle for ramming other vehicles. The front ramrod extends beyond the front bumper of the vehicle and the rear ramrod extends beyond the rear bumper of the vehicle. A magnet is positioned at the base of the vehicle for vehicle propulsion.

In operation, a player will propel his vehicle on the gameboard surface by means of a propelling magnet held beneath the game board and attempt to ram other vehicles with the ramrod, there being a ramrod at the front and rear of the vehicle. Impact of the ramrod with one of the bumpers or fenders will force such bumper or fender further into the groove in which it is positioned and force the associated shaft and spring outward at the other side, thereby forcing the fender or bumper on the other side out of the grooves and onto the playing surface.

BRIEF DESCRIPTION OF THE DRAWINGS

FIG. 1 is a top sectional view of a vehicle in accordance with the present invention;

FIG. 2 is a front sectional view of a vehicle in accordance with the present invention;

FIG. 3 is a side sectional view of the vehicle in accordance with the present invention;

FIG. 4 is a view of a magnetic manipulator in accordance with the present invention;

DESCRIPTION OF THE PREFERRED EMBODIMENT

Figures 5, 6:
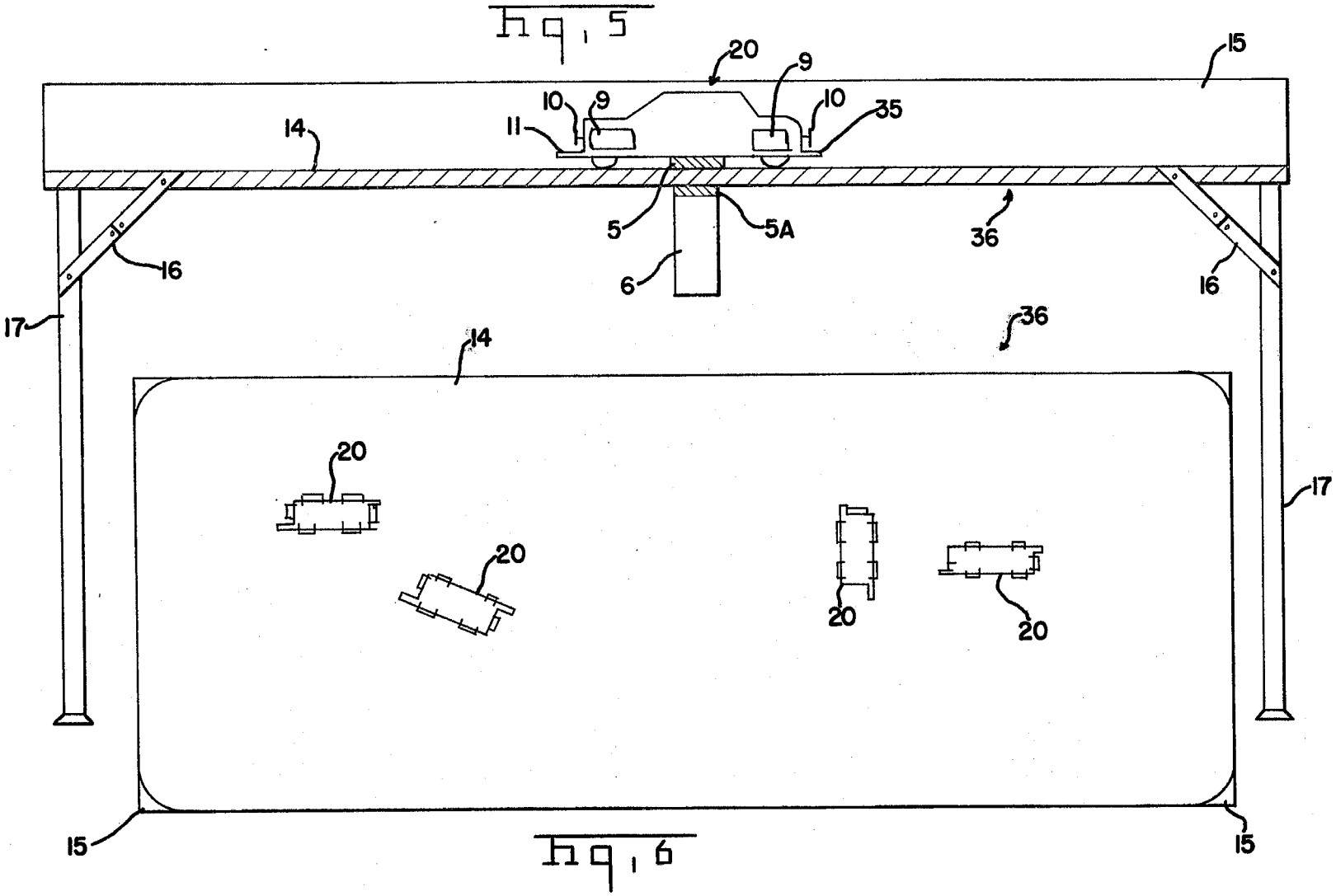
FIG. 5 is a side view in section of a playing table with vehicle thereon in accordance with the present invention.
FIG. 6 is a top view of a playing surface with vehicles thereon in accordance with the present invention.

Referring now to FIGS. 1 to 3 there is shown a vehicle 20 in accordance with the present invention. The vehicle can be, for example, made of solid plastic or other material which is in the shape of an automobile 20. An aperture 21 extends along the front to back axis of the vehicle and therewithin. A further pair of apertures 22 and 23 is positioned transverse to the aperture 21 and either above or below the aperture 21 but not in the same plane. The apertures 22 and 23 are positioned at opposite end portions of the vehicle 20. A magnet 5 is secured in the under region of the vehicle, the lower portion of the magnet 5 being at about the same level as the bottom of the wheels 24 of the vehicle, the wheels being either rigid and non-rotatable or rotatable. Positioned in the aperture 21 is a shaft 7 having spring members 12 secured at opposite ends thereof, the length of the shaft 7 plus spring members 12 when in the relaxed state being slightly larger than the length of the aperture 21. Each of the spring members 12 is secured to a disc 25 which is larger in diameter or cross section than the diameter or cross section of the aperture 21, thereby preventing the shaft 7 and springs 12 from moving completely out of the aperture 21. A set of grooves 13 is formed in each of the front and rear ends of the vehicle and a bumper 10 is positioned in each of the grooves 13 in loose fitting contact therewith so that movement of a disc 25 thereagainst will force the bumper out of the grooves 13. A further pair of identical shafts 8 is provided, one in each of the apertures 22 and 23 with a spring 32 secured to each side of each of the shafts 8, the total length of each shaft 8 and the spring member 32, when in the relaxed condition, being greater than the length of the aperture 22 or 23. A disc 34 is positioned on and secured to each of the spring members 32, the same as the discs 25. A set of grooves 33 is positioned about each of the discs 34 and a fender 9 is positioned in each of the grooves 33 in the same manner as the bumpers 10. The fenders are removably positioned in said grooves 33 by the movement of the shaft 8, spring 32 and disc 34 thereagainst to push the fender out of the grooves. The vehicle also includes a ramrod 11 on its front end adjacent the front bumper and extending forwardly of said bumper as well as a ramrod 35 on the rear of the vehicle adjacent the rear bumper and extending rearwardly beyond said rear bumper.

The bumpers 10 and fenders 9 are positioned in the grooves 13 and 33 respectively, so that they do not touch the innermost surfaces of said grooves and can therefore be driven inwardly to force the adjacent disc inwardly, thereby moving the attached spring and shaft in the opposite direction. This will force the spring on the opposite end of the shaft outwardly and force the spring and disc on the other end of the shaft to force the disc shaft or bumper thereat out of its grooves and onto the gameboard.

Referring now to FIGS. 4 and 5, there is shown a gameboard in the form of a folding table having a top surface 14 formed of rigid thin plastic, wood or other suitable non-magnetic material. Positioned around the outer edges of the board 14 is a fence 15 which is sufficiently high to prevent a vehicle from being driven off of the board. The board includes legs 17 which can be folded under the table by means of hinges 16 in well known manner. Also shown in FIGS. 4 and 5 is a hand manipulator 6 with a magnet 5A at the upper surface thereof for magnetic coupling with the magnet 5 on the vehicle which will be explained hereinbelow.

In operation, there will be a plurality of players, each player being assigned a vehicle 20, four such vehicles being shown on FIG. 6. Each operator will have a hand manipulator 6 in the from of a handle with magnet 5A at one end and will place said manipulator under the table 36 and beneath the vehicle 20 assigned to him. By movement of the magnet 5A beneath and against the table 14, the vehicle will follow the movement of the manipulator 6 in well-known manner. The vehicle will be driven so that it will strike on opponent's vehicle with one of the ramrods 11 and 35 along one of the fender or bumper members. Since the fender and bumper means are positioned in their respective grooves in the vehicle with a certain amount of play, there is room for such bumper and fender members to be moved inwardly of the grooves when impacted with a ramrod, thereby forcing the corresponding shaft to move in the direction toward the other end of the vehicle and impart a force to the opposite bumper or fender. This force will force the opposite fender or bumper out of the grooves and onto the playing surface. This procedure is continued until a player has lost all of the bumper and fender members from his vehicle whereupon his vehicle is removed from the game. The player remaining when all of his opponents have had all of the bumper and fender members removed from their vehicles is declared the winner.

Though the invention has been described with respect to a specific preferred embodiment thereof, many variations and modifications will immediately become apparent to those skilled in the art. It is therefore the intention that the appended claims be interpreted as broadly as possible in view of the prior art.

What is claimed is:

1. A demolition derby toy which comprises, in combination, (a) a vehicle, (b) shaft means slidably positioned in said vehicle along a vehicle axis and greater in length than said vehicle axis in said vehicle along which it lies, (c) removable vehicle component means spanning a vehicle axis and removable from said vehicle in response to movement of said shaft means against said removable vehicle component, and (d) ram means on said vehicle extending outwardly from said vehicle beyond a removable component means, wherein each said shaft means includes a shaft, a spring on each end of said shaft and a disc on each said spring, the distance between said discs being greater than the length of the vehicle along the shaft axis, said movable component means spanning said discs, said vehicle having grooves on opposite sides of said discs, said removable component means being removably positioned in said grooves and capable of both inward and outward movement in said grooves.

2. A demolition derby toy as set forth in claim 1 wherein said shaft means includes a first shaft slidably positioned along a front to back axis of said vehicle and a second shaft out of the plane of said first shaft and positioned transverse thereto.

3. A demolition derby toy as set forth in claim 1 further including a magnet on the lower surface of said vehicle.

4. A demolition derby toy as set forth in claim 2 further including a magnet on the lower surface of said vehicle.

5. A demolition derby toy which comprises, in combination, (a) a vehicle, (b) shaft means slidably positioned in said vehicle along a vehicle axis for reciprocating movement and greater in length than said vehicle along said axis in which it is positioned, said shaft means extending beyond said vehicle at both ends of said axis, (c) removable vehicle component means positioned on said vehicle and removable from said vehicle in response to a force applied thereto directly by said shaft means against said removable vehicle component, and (d) ram means positioned on said vehicle extending outwardly from said vehicle beyond a removable component means.

6. A demolition derby toy as set forth in claim 5 wherein said shaft means includes a first shaft slidably positioned along a front to back axis of said vehicle and a second shaft out of the plane of said first shaft and positioned transverse thereto.

7. A demolition derby toy as set forth in claim 5 further including a magnet on the lower surface of said vehicle.

8. A demolition derby toy as set forth in claim 6 further including a magnet on the lower surface of said vehicle.

* * * * *